United States Patent [19]

Danelia et al.

[11] 4,139,372

[45] Feb. 13, 1979

[54] COPPER-BASED ALLOY

[76] Inventors: Evgeny P. Danelia, ulitsa Butyrskaya, 5, kv. 25; Vladimir M. Rozenberg, ulitsa Baikalskaya, 40/17, kv. 76; Vladimir I. Solopov, ulitsa Bolshaya Dekabrskaya, 4, kv. 45; Jury F. Shevakin, Telegrafny pereulok, 11/16, kv. 53; Efim S. Shpichinetsky, ulitsa Donetskaya, 6, kv. 93; Ilya S. Berin, ulitsa Papernika, 8, kv. 95; Emmanuil Z. Yankovsky, Novo-Gireevo, Saperny proezd, 4, kv. 12; Max A. Entin, ulitsa Fridrikha Engelsa, 28/30, korpus 1, kv. 90, all of Moscow, U.S.S.R.

[21] Appl. No.: 837,612

[22] Filed: Sep. 28, 1977

[51] Int. Cl.[2] ..... C22C 9/01; C21D 1/00; C22F 1/08

[52] U.S. Cl. ..... 75/162; 75/164; 148/160

[58] Field of Search ..... 75/153, 162, 164; 148/11.5 C, 12.7 C, 13.2, 160

[56] References Cited

U.S. PATENT DOCUMENTS

| | | | |
|---|---|---|---|
| 3,259,401 | 7/1966 | Pryor | 75/162 |
| 3,615,899 | 10/1971 | Kimura et al. | 148/11.5 C |
| 3,928,028 | 12/1975 | Yarwood | 75/153 |
| 4,007,039 | 2/1977 | Shapiro et al. | 75/153 |

FOREIGN PATENT DOCUMENTS

| | | | |
|---|---|---|---|
| 522247 | 10/1976 | U.S.S.R. | 75/153 |

*Primary Examiner*—L. Dewayne Rutledge
*Assistant Examiner*—Peter K. Skiff
*Attorney, Agent, or Firm*—J. Harold Nissen

[57] ABSTRACT

A copper-based alloy also contains aluminium and hafnium expressed as weight percentages:

aluminium 0.01 to 1
hafnium 0.005 to 1
copper the balance.

The alloy may also contain 0.01 to 1% by weight of titanium.

The proposed alloy combines high electrical conductivity which is 75 to 99% of that of copper, together with increased mechanical strength at room temperature and an ability to maintain its high strength during shorter long term exposure to temperatures.

8 Claims, No Drawings

COPPER-BASED ALLOY

The present invention relates to metallurgy, and more particularly to a copper-based alloy.

The proposed alloy finds application in electrical engineering, electronics and instrument-making, as well as in a number of mechanical engineering branches for use in heat-resistant conductors, tools for electric spark treatment, welding electrodes, commutator bars, windings of power transformers, and elements of electronic devices.

Copper and low copper alloys, cold-hardened or quenched with subsequent precipitation hardening (ageing), are widely used at present as conductor materials. In particular, widely used at present are such copper alloys as strain-hardened silver, cadmium and magnesium bronzes, and precipitation-hardened chromium, zirconium and chromium-zirconium bronzes, said alloys having a sufficiently high electrical conductivity exceeding 70 to 80% of that of copper. Having sufficiently high electrical conductivity exceeding 70 to 80% of that of copper, said alloys as well as pure copper show comparatively low strength properties, especially at elevated temperatures.

At room temperatures the strength of copper and said alloys also drops sharply if they are subjected to preliminary annealing which in a number of cases is a necessary operation in manufacturing articles.

For example, in a hardeneed state the strength of copper and the above-mentioned alloys is characterized by the ultimate tensile strength $\sigma_B$ which amounts from 40 to 50 kg/mm$^2$. After annealing at a temperature of 600° to 1,000° C., $\sigma_B$ drops to 20 to 30 kg/mm$^2$. When the test temperature increases, for example, to 600° and 1,000° C., $\sigma_B$ drops to 5 to 25 and 1 to 2 kg/mm$^2$ respectively. Softening of copper and said alloys during heating takes place due to low thermal stability of their structure. The heating of copper and cold-hardened alloys intensifies the processes of recovery and recrystallization, and, therefore results in the loss of strength.

When heating precipitation-hardening (ageing) alloys, the dispersed particles, representing pure metals, solid solutions or intermetallic compounds, are intensively getting coarse or dissolving in a copper matrix, thereby ceasing to harden the alloy.

There is also known in the art a copper-based alloy containing 0.1 to 1 percent by weight of aluminium and hardened by internal oxidation. Said alloy is intended for use as a heat-resistant conductor material (British Pat. No. 1,152,481, Cl. C 7A).

With a good electrical conductivity (over 85% of that of copper) said alloy, judging by the measurements of hardness, has a considerably higher resistance to loss of strength during annealing than copper and said low copper alloys, i.e. the strength properties of this alloy change little if the alloy is subjected to annealing at temperatures of up to 1,000° C. For example, after annealing at temperatures of 600° to 1,000° C. the hardness of the alloy is 3 times higher than that of annealed copper.

However, the strength of the alloy containing aluminium is comparatively low at room temperature and elevated temperatures — ultimate tensile strength at room temperature is within 45 to 47 kg/mm$^2$, at 600° C. within 15 to 17 kg/mm$^2$, and at 950° C. about 5 kg/mm$^2$.

It is an object of the present invention to provide a copper-based alloy having increased strength at room temperature and elevated temperatures together with electrical conductivity of 75 to 97% of that of copper.

It is another object of the invention to increase the resistance of the alloy to loss of strength during short- and long-term annealing.

It is still another object to provide such an alloy which will feature workability adequate for manufacturing articles of various shapes, such as rods, sections, strips, wires and pipes.

In accordance with said and other objects the substance of the invention resides in that in the proposed copper-based alloy containing aluminium, according to the invention, there also is contained hafnium, the proportions of the constituents being expressed in weight percentages:

aluminium: 0.01 to 1
hafnium: 0.005 to 1
copper: the balance.

The addition of hafnium to the alloy makes it possible to increase ultimate tensile strength, for example at room temperature, up to 48 to 70 kg/mm$^2$ depending on the kind of the semi-fabricated product.

Said level of strength meets the requirements for heatresistance conductors, elements of electronic devices and welding electrodes.

However, in a number of cases where a higher strength is required an alloy also containing from 0.01 to 1 percent by weight of titanium is recommended for said articles.

The addition of titanium to the alloy increases ultimate tensile strength (at room temperature of up to 48 to 85 kg/mm$^2$).

For the production of thin-section conductors, in particular wire of less than 0.2 mm in diameter and strips of less than 0.1 mm in thickness alloys are recommended consisting of, in weight percent:

aluminium: 0.01 to 0.1
hafnium: 0.005 to 0.01
copper: the balance, or aluminium: 0.01 to 0.1
hafnium: 0.005 to 0.01
titanium: 0.01 to 0.05
copper: the balance.

Said alloys feature enhanced workability and high strength ($\sigma_B$ is from 48 to 55 kg/mm$^2$), having electrical conductivity of over 90% of that of copper.

To manufacture wire of not less than 0.2 mm in diameter, strips of not less than 0.1 mm in thickness as well as rods, pipes and other semi-fabricated products it is advisable to use alloys consisting of, in weight percent:

aluminium: 0.1 to 0.5
hafnium: 0.01 to 0.5
copper: the balance or aluminium: 0.1 to 0.5
hafnium: 0.01 to 0.5
titanium: 0.05 to 0.5
copper: the balance.

Said alloys exhibit enhanced strength ($\sigma_B$ is from 50 to 80 kg/mm$^2$) and adequate workability.

To manufacture articles in the form of round-section rods or of sufficiently large sections alloys are recommended consisting of, in weight percent:

aluminium: 0.5 to 1
hafnium: 0.5 to 1
copper: the balance or aluminium: 0.5 to 1
hafnium: 0.5 to 1
titanium: 0.5 to 1:
copper: the balance.

These alloys are characterized by the highest strength ($\sigma_B$ is from 60 to 85 kg/mm$^2$) and hardness, being intended for use in manufacturing welding electrodes, commutator bars, and tools for electric-spark treatment.

A distinguishing feature of the alloy is also its high resistance to loss of strength during short- and long-term heating at temperatures of up to 1,050° C.

By varying the chemical composition of the alloy within the proposed limits and the conductions of treatment including working and annealing, it is possible to obtain different combinations of strength, ductility and electrical conductivity which can meet the requirements for articles. For example, ultimate tensile strength at room temperature is within 48 to 85 kg/mm$^2$, and electrical conductivity varies from 75 to 97% of that of copper.

After annealing at temperatures of 600° to 1,050° C. the alloy maintains ultimate tensile strength $\sigma_B$ at 35 to 65 kg/mm$^2$. Relative elongation of the alloy which characterizes its ductility after hot working or annealing is from 3–5 to 40% depending on the chemical composition.

Table 1

| No. | Chemical composition of the alloy, % by weight | Electrical conductivity, % of that of copper | $\sigma\beta$ Ultimate tensile strength, kg/mm$^2$ at 20° C | at 600° C | at 800° C | at 950° C | at 20° C after annealing for one hour at 1,050° C |
|---|---|---|---|---|---|---|---|
| 1 | Copper | 100 | 40 | 5 | 1–2 | 1–1.5 | 20 |
| 2 | Silver bronze Cu + 0.08 – 0.12 Ag | 98 | 45 | 6 | over 4 | — | about 20 |
| 3 | Cadmium bronze Cu + 0.9 – 1.2 Cd | 80 | 50–60 | 6–8 | over 4 | — | 20–22 |
| 4 | Chromium bronze Cu + 0.8 Cr | 80–85 | 45–55 | 15–20 | over 5 | — | 23–25 |
| O. 5 | Alloy Cu + 27 Al | 88 | 47.6 | 15.1 | 9.8 | 4.5 | — |
| O. 6 | Alloy Cu + 2 Al + 0.05 Ti + 0.01 Hf | 87–91 | 50–80 | 21–35 | 10–26 | 6–20 | 48–57 |

The method for preparing the proposed copper-based alloy resides in the following.

Copper is alloyed with aluminium and, hafnium, or with aluminium, hafnium and titanium taken both in pure state and in the form of their master alloys, in a vacuum or open furnace according to conventional techniques. In case of alloying in an open furnace the melting is carried out under a layer of charcoal. At first pure copper is heated to a temperature of 1,150° to 1,200° C. The melt is maintained at this temperature for 5 to 10 minutes and thereafter the alloying components are added to the melt in the following amounts, in weight percent:

aluminium: 0.01 to 1
hafnium: 0.005 to 1
titanium: 0.01 to 1.

After agitation with a graphite rod the melt is poured into cast iron or graphite molds.

In the process of making semi-fabricated products the alloy is subjected to heat treatment and working.

Table 1 shows the properties of the known copper-based alloys and the proposed copper-based alloy containing 0.2 percent by weight of aluminium, 0.05 percent by weight of titanium, and 0.01 percent by weight of hafnium. The range of values of the properties given in the table for every composition covers various semi-fabricated products and technological routes for their production. As follows from the data given above, the proposed alloy having acceptable electrical conductivity is superior to the known alloys in relation to strength properties over the wide temperature range.

When the alloy contains the alloying components in the following amounts (percent by weight):

aluminium: 0.01 to 0.1
hafnium: 0.005 to 0.01
titanium: 0.01 to 0.05 it has high technological properties and electrical conductivity exceeding 90 to 95% of that of copper. At the same time the strength of the alloy, especially at temperatures higher than 300° to 500° C., as well as at room temperature but after preliminary annealing, is higher than that of the known alloys having the same high electrical conductivity. An increase in the concentration of the alloying components results in an increased strength while the ductility and electrical conductivity are somewhat lower. However, with any combination of said properties the proposed alloy is superior in its strength to the known alloys having the same electrical conductivity.

Concentrations of the alloying elements lower than the proposed limits do not ensure a sufficient strength both in the initial state and after annealing.

An increase in the content of each of the alloying components of more than 1 percent by weight results in an inadmissible decrease of the electrical conductivity and technological properties.

For a better understanding of the present invention specific examples are given below.

EXAMPLE 1

A copper-based alloy containing 0.2 percent by weight of aluminium, 0.05 percent by weight of titanium and 0.01 percent by weight of hafnium, is prepared by alloying copper and master alloys Cu + 50 percent by weight of Al; Cu + 20 percent by weight of Ti; Cu + 20 percent by weight of Hf in a vacuum furnace. For this purpose copper is heated to a temperature of 1,150° C. The melt is maintained at said temperature for 10 minutes and said master alloys are then added to the melt. After agitation of the melt with a graphite rod for one minute it is poured into a cast iron mold. Afterwards semi-fabricated articles are made from the ingot in the form of rods of 15 mm in diameter, wire from 2 to 0.2 mm in diameter and strips 0.15 mm thick. The properties of the semi-fabricated articles are given in Tables 2 to 5. In Table 2 the range of properties refers to wire of 2 to 0.2 mm in diameter.

Table 2

| State | Properties of Wire at Room Temperature: Ultimate tensile strength $\sigma_B$, kg/mm$^2$ | Yield point $\sigma_{0.2}$, kg/mm$^2$ | Relative elongation, $\sigma$ % | Resistivity $\rho$, $\frac{\text{ohm} \cdot \text{mm}^2}{\text{m}}$ | Electrical conductivity, % of that of copper |
|---|---|---|---|---|---|
| 1 | 2 | 3 | 4 | 5 | 6 |
| As-cold drawn | 67–80 | 68–77 | 1–5 | 0.0199 | 87 |
| Annealing at 500° C for one hour | 65–70 | 60–63 | 3–9 | 0.0197 | 87.5 |
| Annealing at 700° C for one hour for one hour | 60–66 | 58–62 | 4–10 | 0.0197 | 87.5 |
| Annealing at 900° C for one hour | 55–61 | 52–59 | 6–12 | 0.0197 | 87.5 |
| Annealing at 1,050° C for one hour | 53–57 | 48–53 | 7–12 | 0.0196 | 88 |

Table 3

| State | Properties of a Strip 0.15 mm thick at Room Temperature: Ultimate tensile strength, $\sigma_B$, kg/mm$^2$ | Yield point $\sigma_{0.2}$, kg/mm$^2$ | Relative elongation $\delta$, $\delta$ % | Resistivity $\rho$, $\frac{\text{ohm} \cdot \text{mm}}{\text{m}}$ | Electrical conductivity, % of that of copper |
|---|---|---|---|---|---|
| As cold-rolled | 65 | 64 | 5 | 0.0202 | 87 |
| Annealing at 500° C, one hour | 55 | 54 | 9 | 0.0200 | 87 |
| Annealing at 1,050° C, one hour | 50 | 47 | 13 | 0.0200 | 88 |

Table 4

| State | Properties of a Rod at Room Temperature: Ultimate tensile strength $\delta_B$, kg/mm$^2$ | Yield point, $\sigma_{0.2}$, kg/mm$^2$ | Relative elongation, $\delta$ % | Resistivity $\rho$, $\frac{\text{ohm} \cdot \text{mm}}{\text{m}}$ | Electrical conductivity, % of that of copper |
|---|---|---|---|---|---|
| As-hot extended | 50 | 44 | 15 | 0.0192 | 90 |
| Annealing at 1,050° C, one hour | 49 | 43 | 20 | 0.0192 | 91 |

Table 5

| Ultimate Tensile Strength $\sigma_B$ (kg/mm$^2$) of Wire of 2 mm in Diameter and Rods of 15 mm in Diameter at Elevated Temperatures | | | | | | |
|---|---|---|---|---|---|---|
| Test temperature, ° C | 20 | 200 | 400 | 600 | 800 | 900 |
| Wire | 67 | 56 | 44 | 35 | 26 | 21 |
| Rods | 50 | 42 | 32 | 20 | 10 | 7 |

EXAMPLE 2

A copper-based alloy containing 0.05 percent by weight of aluminium, 0.01 percent by weight of titanium and 0.005 percent by weight of hafnium, is prepared as described in Example 1.

The proposed alloy is used for making wire of less than 0.2 mm in diameter and strips less than 0.1 mm thick.

Ultimate tensile strength at room temperature of wire of 0.12 mm in diameter and strips 0.08 thick, is 55 kg/mm$^2$; after annealing said semi-fabricated articles at a temperature of 1,050° C. ultimate tensile strength is 35 kg/mm$^2$. The electrical conductivity of the alloy is 94 to 97% of that of copper.

Relative elongation in a hot-worked or annealed (soft) state reaches 20 to 30%.

EXAMPLE 3

A copper-based alloy containing 0.2 percent by weight of aluminium and 0.2 percent by weight of hafnium is prepared as described in Example 1. The prepared alloy has an electrical conductivity of 86 to 88% of that of copper Ultimate tensile strength at room temperature of a rod of 15 mm in diameter made from the prepared alloy is 49 kg/mm$^2$, wire of 0.5 mm in diameter — 60 kg/mm$^2$, and a strip 0.15 mm thick — 57 kg/mm$^2$. Ultimate tensile strength of said semi-fabricated articles after annealing at a temperature of 1,050° C. is 49 to 50 kg/mm$^2$. Relative elongation in hot-worked or annealed state reaches 10 to 20%.

EXAMPLE 4

A copper-based alloy containing 0.5 percent by weight of aluminium, 0.1 percent by weight of titanium and 0.1 per cent by weight of hafnium, is prepared as described in Example 1. A rod of 15 mm in diameter made from the prepared alloy has an ultimate tensile strength at room temperature of 55 kg/mm$^2$, wire of 0.5 mm in diameter — 80 kg/mm$^2$, and a strip 0.15 mm thick — 67 kg/mm$^2$; after annealing said semi-fabricated articles at a temperature of 1,050° C. the ultimate tensile strength is 55 to 60 kg/mm$^2$. The electrical conductivity of the prepared alloy is 83 to 85% of that of copper.

EXAMPLE 5

A copper-based alloy containing 1 percent by weight of aluminium, 1 percent by weight of titanium and 1 percent by weight of hafnium, is prepared as described in Example 1. A rod of 5 mm in diameter made from the prepared alloy has an ultimate tensile strength at room temperature of 80 kg/mm$^2$, a strip 2 mm thick — 85 kg/mm$^2$. After annealing said semi-fabricated articles at a temperature of 1,050° C. the ultimate tensile strength is 60 to 65 kg/mm$^2$.

The electrical conductivity of the alloy is 75 to 77% of that of copper.

What is claimed is:

1. A copper-based alloy possessing an increased mechanical strength both at room and elevated temperatures combined with an electrical conductivity of 75 to 97% of that of copper, containing, as percent by weight:
aluminium: 0.01 to 1
hafnium: 0.005 to 1
copper: the balance.

2. An alloy as claimed in claim 1, consisting of, in weight percent:
aluminium: 0.01 to 0.1
hafnium: 0.05 to 0.01
copper: the balance.

3. An alloy as claimed in claim 1, consisting of, in weight percent:
aluminium: 0.1 to 0.5
hafnium: 0.01 to 0.5
copper: the balance.

4. An alloy as claimed in claim 1, consisting of, in weight percent:
aluminium: 0.05 to 1
hafnium: 0.5 to 1
copper: the balance.

5. A copper-based alloy as claimed in claim 1, further containing from about 0.01 to 0.05% by weight of titanium to increase the tensile strength of the resulting alloy from 70 to 85 kg/mm$^2$.

6. An alloy as claimed in claim 5, consisting of, in weight percent:
aluminium: 0.01 to 0.1
hafnium: 0.005 to 0.01
titanium: 0.01 to 0.05
copper: the balance.

7. The alloy as claimed in claim 5, consisting of, in weight percent:
aluminium: 0.01 to 0.05
hafnium: 0.01 to 0.05
titanium: 0.05 to 0.5
copper: the balance.

8. The alloy as claimed in claim 5, consisting of, in weight percent:
aluminium: 0.5 to 1
hafnium: 0.05 to 1
titanium: 0.5 to 1
copper: the balance.

* * * * *

UNITED STATES PATENT AND TRADEMARK OFFICE

CERTIFICATE OF CORRECTION

PATENT NO. : 4,139,372

DATED : February 13, 1979

INVENTOR(S) : DANELIA et al

It is certified that error appears in the above–identified patent and that said Letters Patent are hereby corrected as shown below:

Col. 8, Line 28 "aluminium: 0.01 to 0.05" should be --aluminium: 0.1 to 0.5-- .

Signed and Sealed this

*Eleventh* Day of *December 1979*

[SEAL]

*Attest:*

SIDNEY A. DIAMOND

*Attesting Officer*

*Commissioner of Patents and Trademarks*